US007331689B2

(12) United States Patent
Chen

(10) Patent No.: US 7,331,689 B2
(45) Date of Patent: Feb. 19, 2008

(54) LIGHT-EMITTING DEVICE

(75) Inventor: Hai-Han Chen, Taichung (TW)

(73) Assignee: Grand Halo Technology Co., Ltd., Taichung (TW)

( * ) Notice: Subject to any disclaimer, the term of this patent is extended or adjusted under 35 U.S.C. 154(b) by 0 days.

(21) Appl. No.: 11/510,695

(22) Filed: Aug. 28, 2006

(65) Prior Publication Data

US 2007/0285922 A1 Dec. 13, 2007

(30) Foreign Application Priority Data

Jun. 12, 2006 (TW) ..... 95210244 U

(51) Int. Cl.
*F21V 1/00* (2006.01)

(52) U.S. Cl. ..... 362/240; 362/244; 362/251; 362/294

(58) Field of Classification Search ..... 362/240, 362/244, 246, 249, 251, 294, 331, 332, 333, 362/335, 648, 800
See application file for complete search history.

(56) References Cited

U.S. PATENT DOCUMENTS 4,729,076 A * 3/1988 Masami et al. ..... 362/800
5,515,253 A * 5/1996 Sjobom ..... 362/332
6,578,979 B2 * 6/2003 Truttmann-Battig ..... 362/240
6,665,170 B1 * 12/2003 Warner et al. ..... 362/249
6,726,348 B2 * 4/2004 Gloisten ..... 362/249
2004/0264195 A1 * 12/2004 Chang et al. ..... 362/294
2006/0146531 A1 * 7/2006 Reo et al. ..... 362/244

FOREIGN PATENT DOCUMENTS

TW 284176 6/1994
TW 285658 10/1994
TW 286898 10/1996

* cited by examiner

*Primary Examiner*—Y. My Quach-Lee
(74) *Attorney, Agent, or Firm*—Birch, Stewart, Kolasch & Birch, LLP

(57) ABSTRACT

A light emitting device is disclosed, in which a body is provided with a first joining portion, light-emitting elements located at a side of the body having the first joining portion for emitting light and an optical processing element disposed at a side of the light-emitting elements having a second joining portion corresponding to the first joining portion for processing light emitted from each light-emitting element, such that even light emission is obtained.

19 Claims, 7 Drawing Sheets

LIGHT-EMITTING DEVICE

FIELD OF THE INVENTION

The present invention relates to an illuminating technique, and more particularly, to a light-emitting device with a plurality of light-emitting elements.

BACKGROUND OF THE INVENTION

Traditional illumination usually uses fluorescent lamps as the light source, which allows high speed electrons in argon or neon gas to excite mercury by collision to produce ultraviolet light. The ultraviolet, when strikes a phosphor powder coated in the lamps, emits visible fluorescence for illumination. Since light source provided by this kind of illumination varies with AC current, flickering of the light source may directly affect the users' eyesight. Additionally, the mercury element inside the fluorescent lamps may be harmful to the human bodies. Disposing of the fluorescent lamps may also pollute the environment. Furthermore, applications of this type of lightings require electronic ballast or high-frequency inverter. It also has the shortcomings of slow starting, high power consumption and heat emission.

In light of these concerns, Light Emitting diodes (LEDs) are being developed. Compared to the lighting technique that adopts fluorescent lamps, LEDs is advantageous in having a smaller volume, lower heat emission (less heat radiation), lower power consumption (lower voltage, lower startup current), longer rated life (above 100,000 hours), high reaction speed (can be operated at high frequency), environmental friendly (vibration and impact resistant, recyclable and non-polluting). Additionally, it can be flat packaged, which is useful in development of compact and light products. Therefore, LEDs are becoming the main choices of light sources instead of fluorescent lamps. Details related to the LEDs technologies are for example disclosed in TW Utility Model Pat. No. M286898, M285658 and M284176.

TW Utility Model Pat. No. M286898 discloses an LED sheet lighting, which uses a single-module LED sheet or more than one LED sheets combining together to replace the traditional tubular lightings or projection lightings with high power consumption, weak illuminance and reduced illuminance over time.

TW Utility Model Pat. No. M285658 discloses lighting with improved illuminance, in which an optical shade disposed at the opening of a lamp shell is a transparent optical lens. The inner and outer faces of the optical shade are both concave/convex spherical arcs. A receiving hole is provided in the inner face. At the bottom of the receiving hole is a concave/convex spherical arc face. As such, an LED is located in the receiving hole facing towards the opening of the lamp shell for improved illuminance.

TW Utility Model Pat. No. M284176 discloses a "smart" LED lighting. A control unit and a setting switch designed to provide several setting modes are provided on a circuit board. The control unit is used to provide a LED with a current corresponding to the setting mode received and a luminance signal received by a light sensor. Thereby, the luminance of the lighting can be adjusted according to the ambient luminance in cooperation with the setting mode.

However, in the abovementioned techniques, the total light throughput is small due to the above structures being limited to dispose only one or a limited number of LEDs. Additionally, a LED light source is a point light source, which can not be distributed evenly on the light emergence face.

Moreover, TW Utility Model Pat. No. M286898 and M284176 do not provide any heat dissipating mechanism, the life of the LEDs are reduced due to large heat emission. Although TW Utility Model Pat. No. M285658 incorporates a heat dissipating board, but current goes through the heat dissipating board, i.e. the driving circuit closely abuts the heat dissipating system, which may result in heat loss due to concentrated heat source. This causes loss of optical energy and affects the reliability of the lighting. Furthermore, the above patents lack an over-voltage protection design. Accordingly, in a fixed-current mode, voltage cannot be stabilized at an operating range since the LED driving element cannot provide the over-voltage protection design.

In addition, TW Utility Model Pat. No. M286898 and M284176 do not provide a LED structure that can be easily assembled or disassembled. While only a single LED can be provided in TW Utility Model Pat. No. M285658, the whole lighting fixture needs to be decomposed during assembly or disassembly, so the problem regarding assembly and disassembly still exists.

Therefore, there is a need for an improved illumination technique that addresses the aforementioned shortcomings.

SUMMARY OF THE INVENTION

In the light of forgoing drawbacks, an objective of the present invention is to provide a light-emitting device having a large total light throughput and even light emission.

Another objective of the present invention is to provide a light-emitting device having heat-and electricity separation to reduce heat dissipation while providing protection.

Still another objective of the present invention is to provide a light-emitting device having a long rated life.

Yet another objective of the present invention is to provide a light-emitting device that can be easily assembled and disassembled.

Still another objective of the present invention is to provide a light-emitting device with high reliability.

In accordance with the above and other objectives, the present invention provides a light-emitting device, comprising: a body including a first joining portion; a plurality of light-emitting element located at a side of the body having the first joining portion for emitting light; and an optical processing element disposed at a side of the plurality of light-emitting elements including a second joining portion corresponding to the first joining portion for processing light emitted from each light-emitting element, such that even light emission is obtained.

In the above light-emitting device, the body is a hollow frame, and the first joining portion is a track. In a preferred embodiment, further comprises a base for disposing the light-emitting elements. The base is a metal heat-dissipating base. The body further comprises a third joining portion. The base comprises a fourth joining portion corresponding to the third joining portion. In addition, the base further includes an adhesive gel for fixing the light-emitting elements on the base, a groove on a face of the base, a wave structure on the other face of the base, a printed circuit board in the groove having a plurality of receiving portions for receiving the light-emitting elements, gold wires for electrically connecting the printed circuit board and the light-emitting elements, an epoxy resin filled in the receiving portions for covering the light-emitting elements and power lines through the base and electrically connected to the printed circuit board.

Preferably, the light-emitting elements are first connected in parallel then in series for electrical connection. The above light-emitting device further comprises at least one voltage regulator, which can be a Zener diode, electrically connected to at least one of the light-emitting elements. In a preferred embodiment, one of the at least one voltage regulator is connected to nine light-emitting elements.

The optical processing element is a transparent spreading plate, comprising a first face and a second face opposite to the first face, wherein the first face is provided with a first processing portion and the second face is provided with a second processing portion. Preferably, the first processing portion is a continuous-arc pattern and the second processing portion is also a continuous-arc pattern, wherein the radius of the arc pattern of the first processing portion is not equal to that of the arc pattern of the second processing portion.

The second joining portion is one of a protruding rib and a tenon. The above light-emitting device further comprises a fastening element located at one end of the body, which may be an end cap in one embodiment.

BRIEF DESCRIPTION OF THE DRAWINGS

The present invention can be more fully understood by reading the following detailed description of the preferred embodiments, with reference made to the accompanying drawings, wherein:

FIGS. 2A to 2C are schematic diagrams depicting the enlarged base of FIG. 1, wherein FIG. 2A is a cross-sectional view of the base of FIG. 1, FIG. 2B is a three-dimensional view of FIG. 2A and FIG. 2C is a partial enlarged view of FIG. 2B;

FIGS. 3A and 3B are schematic diagrams depicting the enlarged optical processing element of FIG. 1, wherein FIG. 3A shows a front view of the optical processing element while FIG. 3B shows a back view of the optical processing element;

DETAILED DESCRIPTION OF THE EMBODIMENTS

The present invention is described by the following specific embodiments. Those with ordinary skills in the arts can readily understand the other advantages and functions of the present invention after reading the disclosure of this specification. The present invention can also be implemented with different embodiments. Various details described in this specification can be modified based on different viewpoints and applications without departing from the scope of the present invention.

First Embodiment

Figure 1:
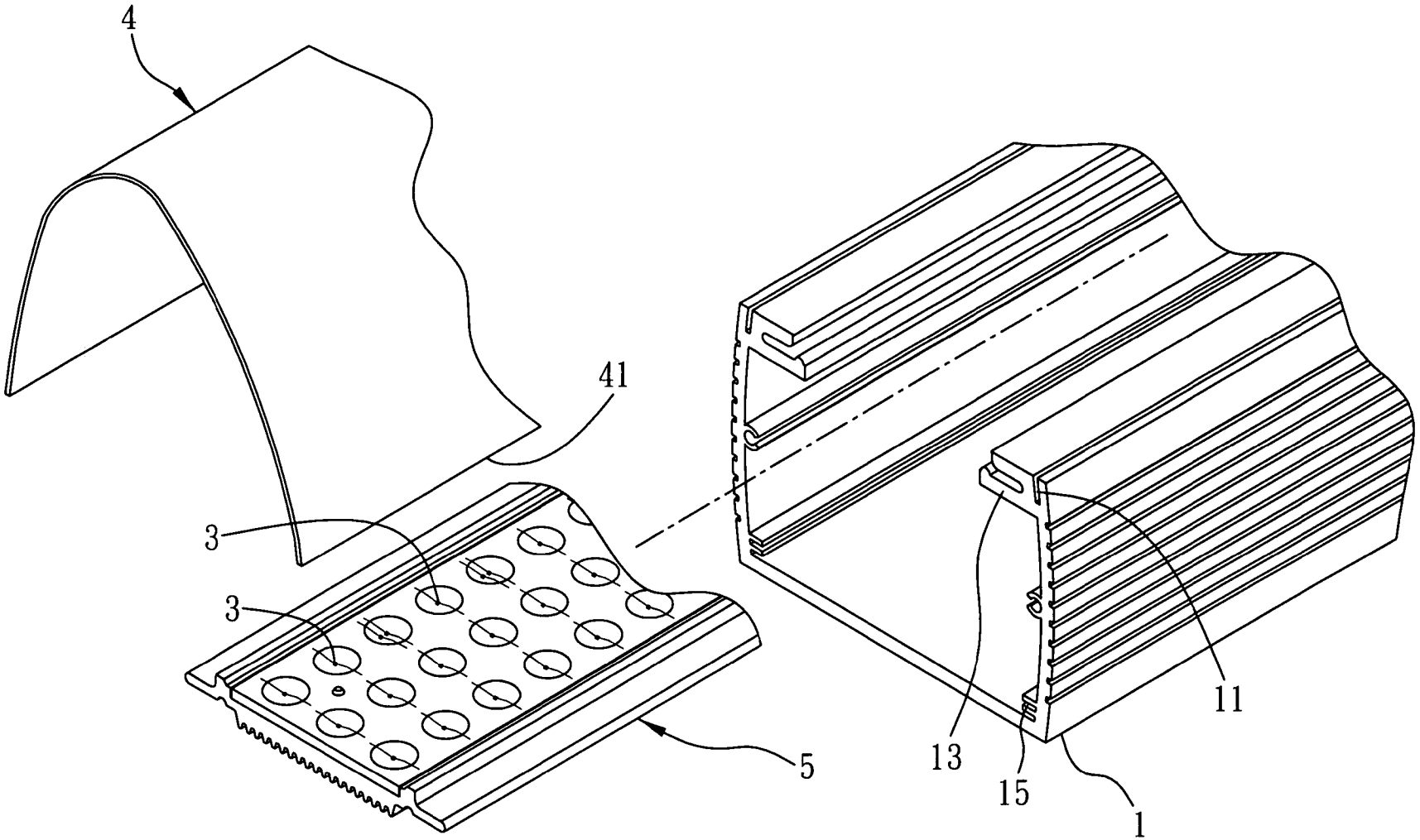
FIG. 1 is an exploded diagram illustrating the first embodiment of the light-emitting device of the present invention.

FIGS. 1 to 5 are diagrams depicting a first embodiment of the light-emitting device of the present invention. Referring to FIG. 1, an exploded diagram of the first embodiment of the light-emitting device of the present invention is shown. The light-emitting device of the present invention comprises a body 1, a plurality of light-emitting elements 3 at a side of the body 1 and an optical processing element 4 at a side of the light-emitting elements 3.

A first joining part 11 is provided at a side of the body 1 for joining with the optical processing element 4. In this embodiment, the body is a hollow frame and the first joining part 11 can, for example, be a track. Meanwhile, the body 1 further comprises a third joining part 13 that can also be, for example, a track. The third joining part 13 is substantially perpendicular to the first joining part 11.

Figure 2A:
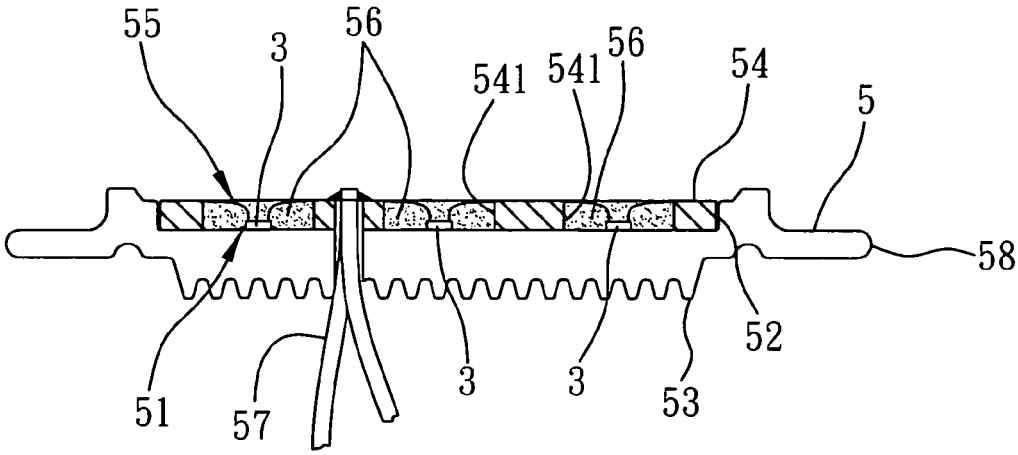

The light-emitting elements 3 are disposed at the side of the body having the first joining part 11 for emitting light. In this embodiment, the light-emitting elements 3 are LEDs. The chip of the light-emitting elements 3 is a double-electrode chip. The light-emitting elements 3 can be placed on a base 5. As shown in FIG. 2A, the base can be a metal heat-dissipating base with good heat dissipation, and may comprises adhesive gel 51 for fixing the light-emitting elements 3 on the base 5, a groove 5, a groove 52 on a face thereof, a wave structure 53 on the other face thereof, a printed circuit board 54 in the groove 52 having a plurality of receiving portions 541 for receiving the light-emitting elements 3, gold wires 55 for electrically connecting the printed circuit board 54 and the light-emitting elements 3, an epoxy resin 56 filled in the receiving portions 541 for covering the light-emitting elements 3, power lines 57 through the base and electrically connected to the printed circuit board 54 and a fourth joining portion 58 corresponding joined with the third joining portion 13.

In this embodiment, the base 5 is for example a sheet with width of 20-60 and length of 60-160 nm for arranging light-emitting elements 3 in a matrix of 20-80 thereon. Each of the light-emitting elements 3 can be first connected in parallel and then in series for electrical connection and a single direct current (DC) is provided by the power line 57. Depending on the number and models of the chips in the light-emitting elements 3, the power can have a range between 1.0 to 5.0W. The adhesive gel 51 can be a silver gel or insulating gel, but it is not limited to these. The printed circuit board 54 can for example have a width of 15 to 50 nm and length of 60 to 160 mm. The receiving portions 541 can be circular holes in a square matrix. Fluorescent power can also be included in the epoxy resin 56, but it is not compulsory. The power line 57 penetrates the base 5 and soldered on the printed circuit board 54. Consequently, current does not go through the base 5 via a heat and electricity separating technique.

Figure 2B:
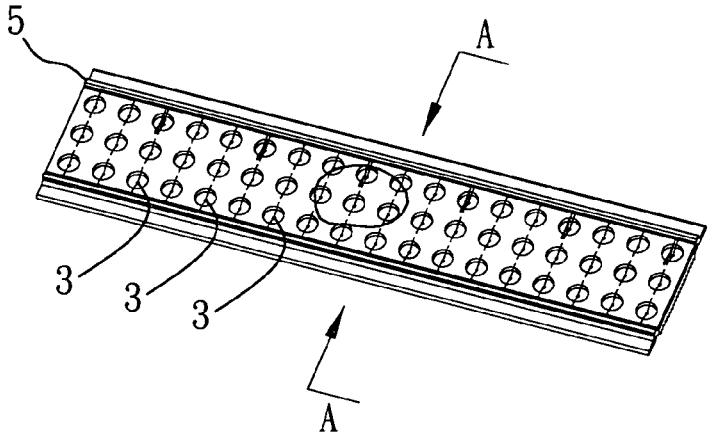
Figure 2C:
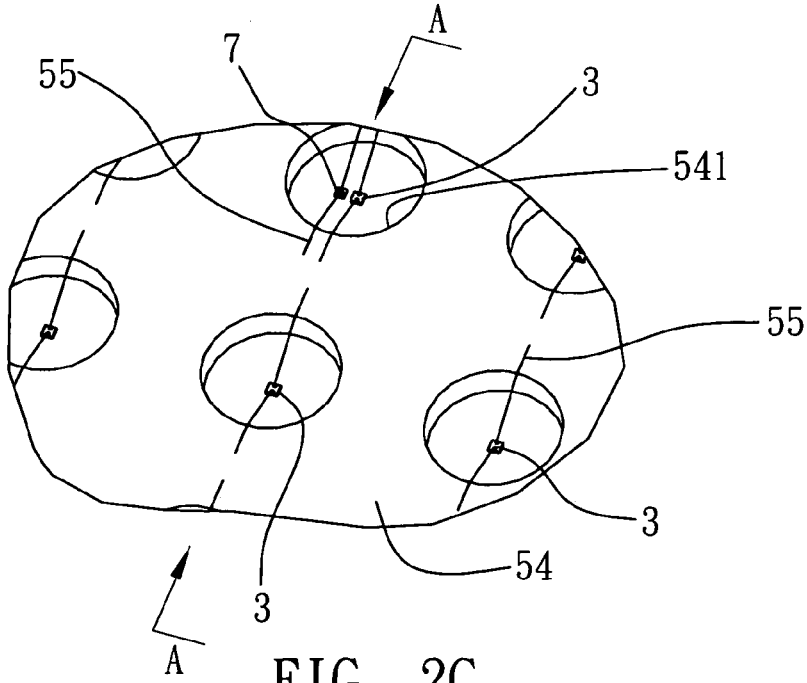

Meanwhile, as shown in FIG. 2B, the light-emitting elements 3 are arranged in a matrix on the base 5; as shown in FIG. 2C, some of the receiving potions 541 comprise both the light-emitting element 3 and a voltage regulator 7. The voltage regulator 7 can be, for example, a Zener diode or other equivalent elements for protecting over voltage. In this embodiment, the voltage regulators 7 are fixed in the receiving portions 541 by the adhesive gel 51 and connected to the printed circuit board 54 via the gold wires 55. Additionally, one voltage regulator 7 is electrically connected to nine light-emitting elements 3, i.e. one voltage regulator 7 is used in cooperation with nine light-emitting elements to regulate the voltage within an operating range. It should be noted that although the voltage regulators 7 are spaced apart at one side of the base 5, but the location and number of the voltage regulators and are not limited to those shown herein as they can be varied according to actual needs.

The optical processing element 4 is provided at one side of the light-emitting elements 3 and comprises a second joining part 41 corresponding to the first joining part 11 for processing the light source from each of the light-emitting elements 3 in order to emit light evenly. The optical processing element 4 can for example be a flexible transparent spreading plate. The second joining portion 41 can be a protruding rib or tenon corresponding to the first joining portion 11, but it is not limited to these. When the first joining portion 11 is not a track but some other structure, the structure of the second joining portion 41 may vary accordingly. This is easily recognized by one with ordinary skills in the art, so it is not described further in details.

Figure 3A:
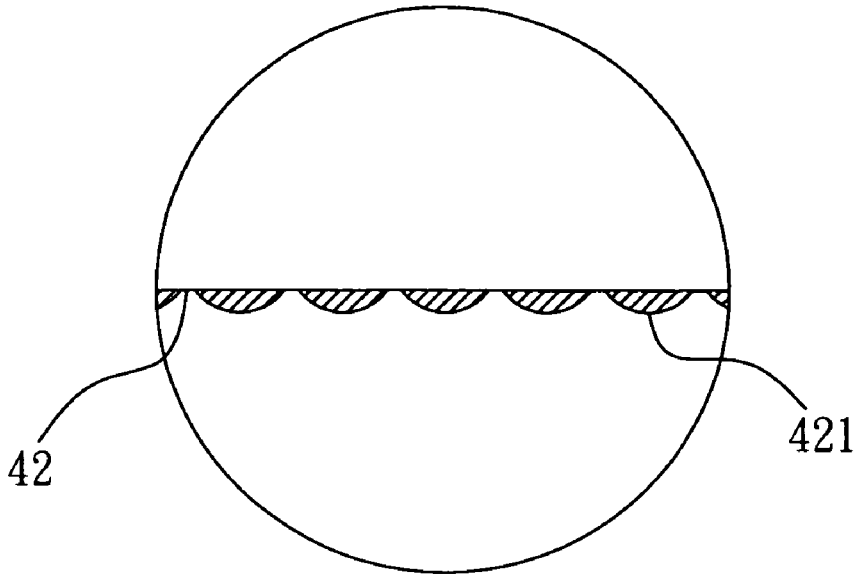
Figure 3B:
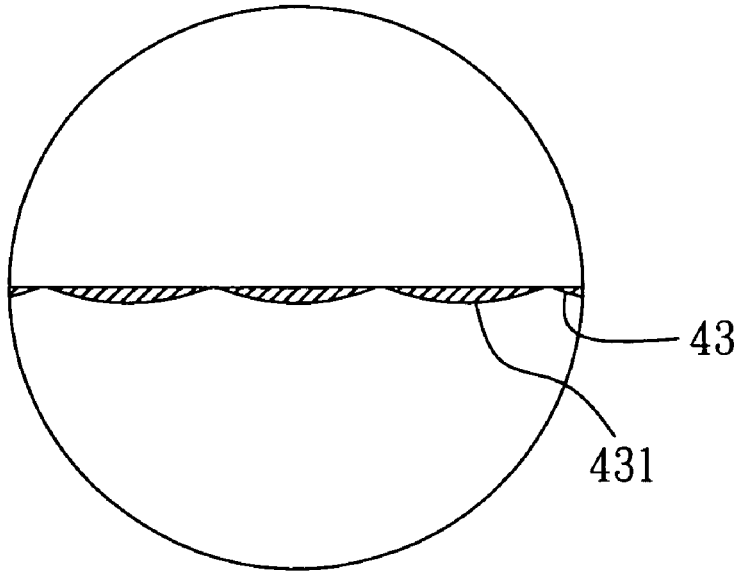

As shown in FIGS. 3A and 3B, the optical processing element 4 comprises a first face 42 and a second face 43 opposite to the first face 42. The first face 42 comprises a first processing portion 421 with a continuous-arc pattern. The second face 43 comprises a second processing portion 431 with a continuous-arc pattern. The results of the arc pattern of the first processing portion 421 is not equal to that of the arc pattern of the second processing portion 431. That is, the arc patterns on the two faces of the optical processing element 4 do not have a matching rhythmic relationship, such that the light source can be changed from a point source to a two-dimensional source via the optical processing element 4, thereby achieving the purpose of outputting an even illumination. In addition, this type of two-dimensional source is softer relative to a point source.

Figure 4:
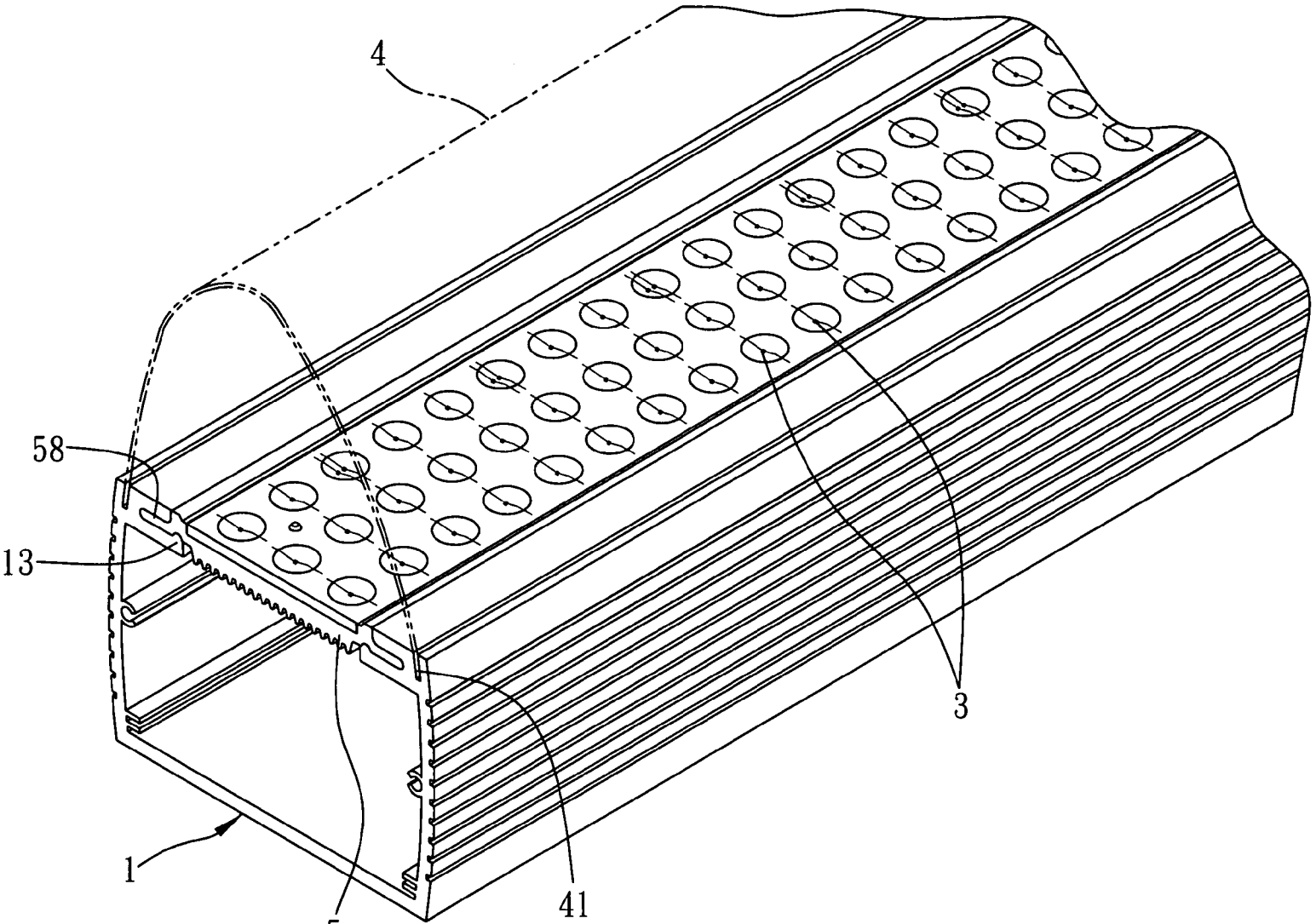
FIG. 4 is an assembly diagram of FIG. 1.

To assemble the light-emitting device of the present invention, the third joining portion 13 is inserted into the fourth portion 58 so as to join the base 5 to the body 1 while the first joining portion 11 is joined with the second joining portion 41 so as to join the optical processing element 4 with the body 1, as shown in FIG. 4, the light-emitting device of the present invention can thus be constructed. On the contrary, when one wishes to dismantle one of the base 5 and the optical processing element 4, it can be directly dismantled without affecting the other.

Figure 5:
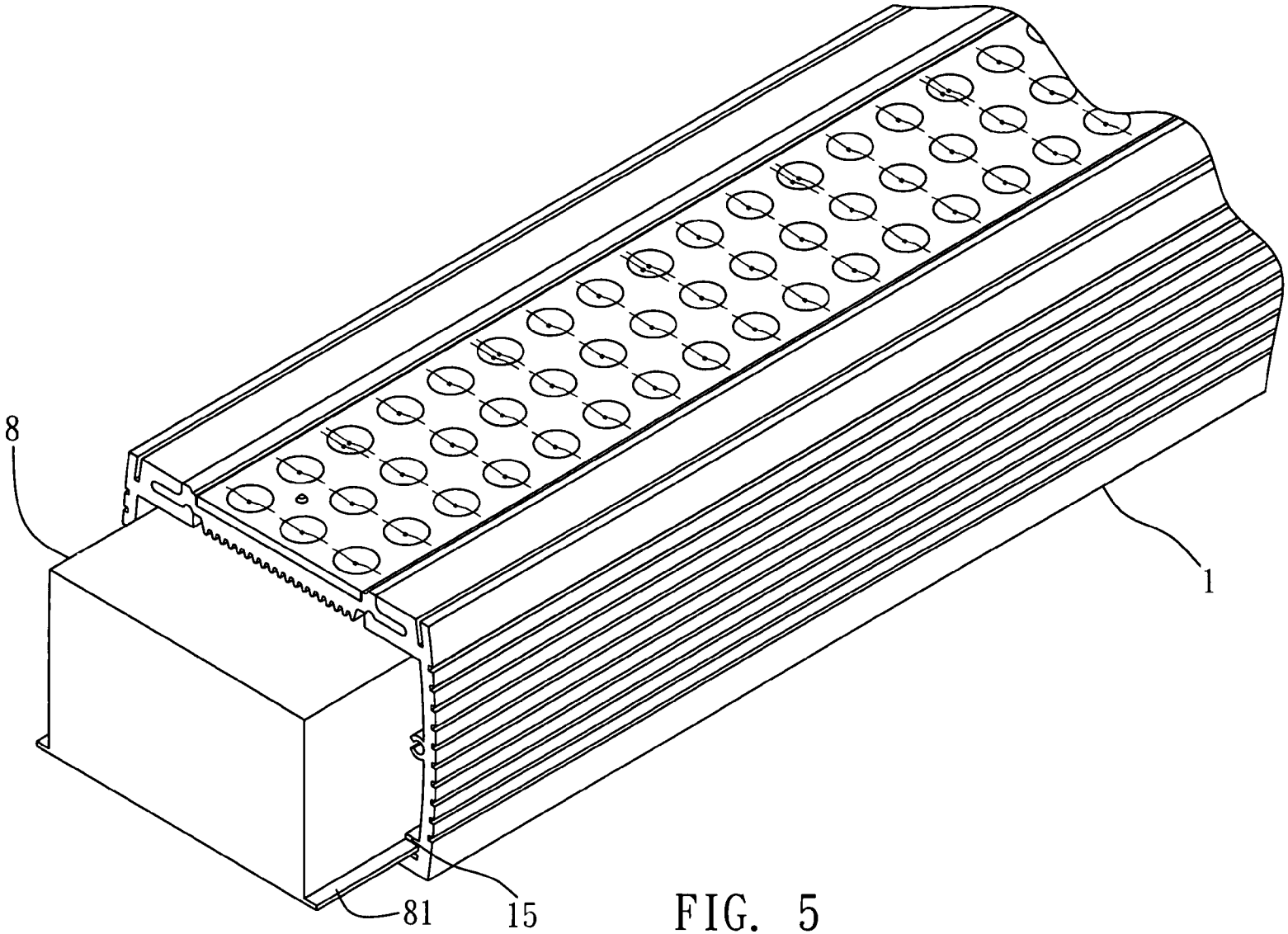
FIG. 5 is a schematic diagram illustrating the assembly of the power supplying unit to the body of FIG. 1.

As shown in FIG. 5, a power supply unit 8 can be installed in the body 1. For example, the body 1 may further comprise a fifth joining portion 15 such as a track. The power supply unit 8 comprises a sixth joining portion 81 correspondingly joined with the fifth joining portion 15, such that the power supplying unit 7 is disposed in the body 1. Meanwhile, the power supplying unit 8 is electrically connected to the power line 57 for providing the required electricity.

It should be noted that the order of the said assembling steps can be reversed and still obtain the same result.

As a result, the plurality of light-emitting elements 3 on the base 5 in the body 1 emits light and the voltage is regulated by the voltage regulators 7 in parallel to at least one of the light-emitting elements 3. The optical processing element 4 on a side of the light-emitting elements 3 may allows even light emission by processing light sources from the light-emitting element 3 using the arc patterns on either faces thereof with a mismatching rhythmic relationship.

Compared to the prior art, the present invention allows more light-emitting elements to be disposed, thus providing greater total light throughput than the prior art and allows even light emission as a result of the surface design on the optical processing element. Meanwhile, the base provides heat dissipation while the current is not passed through the base. Therefore, the light-emitting device of the present invention dissipates less heat and has a longer life and higher reliability. Additionally, the optical processing element and the base can be easily assembled/disassembled to/from the body independent of each other, thereby enabling easy assembly and disassembly.

Second Embodiment

Figure 6:
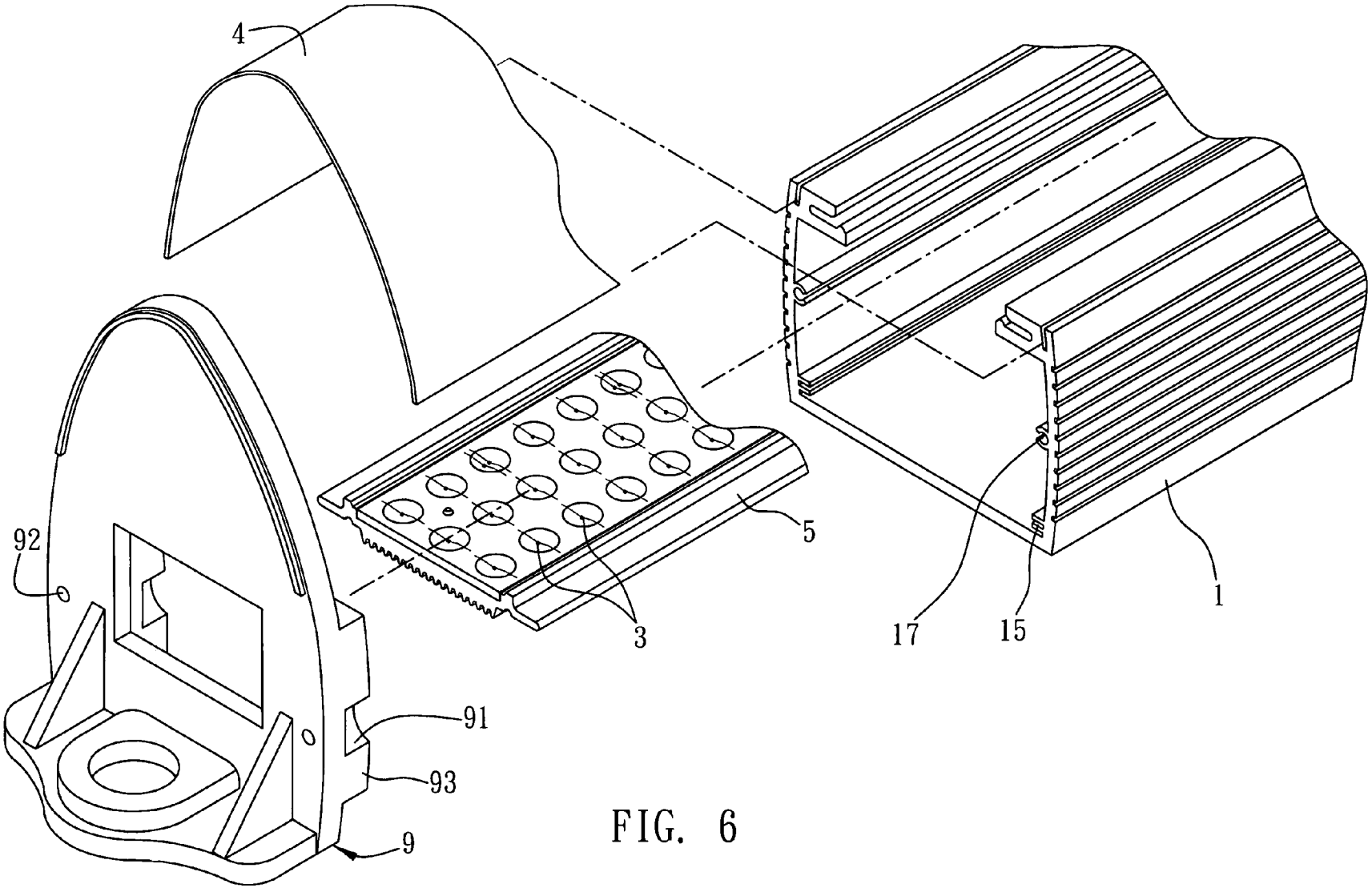
FIG. 6 is an exploded diagram illustrating the second embodiment of the light-emitting device of the present invention.
Figure 7:
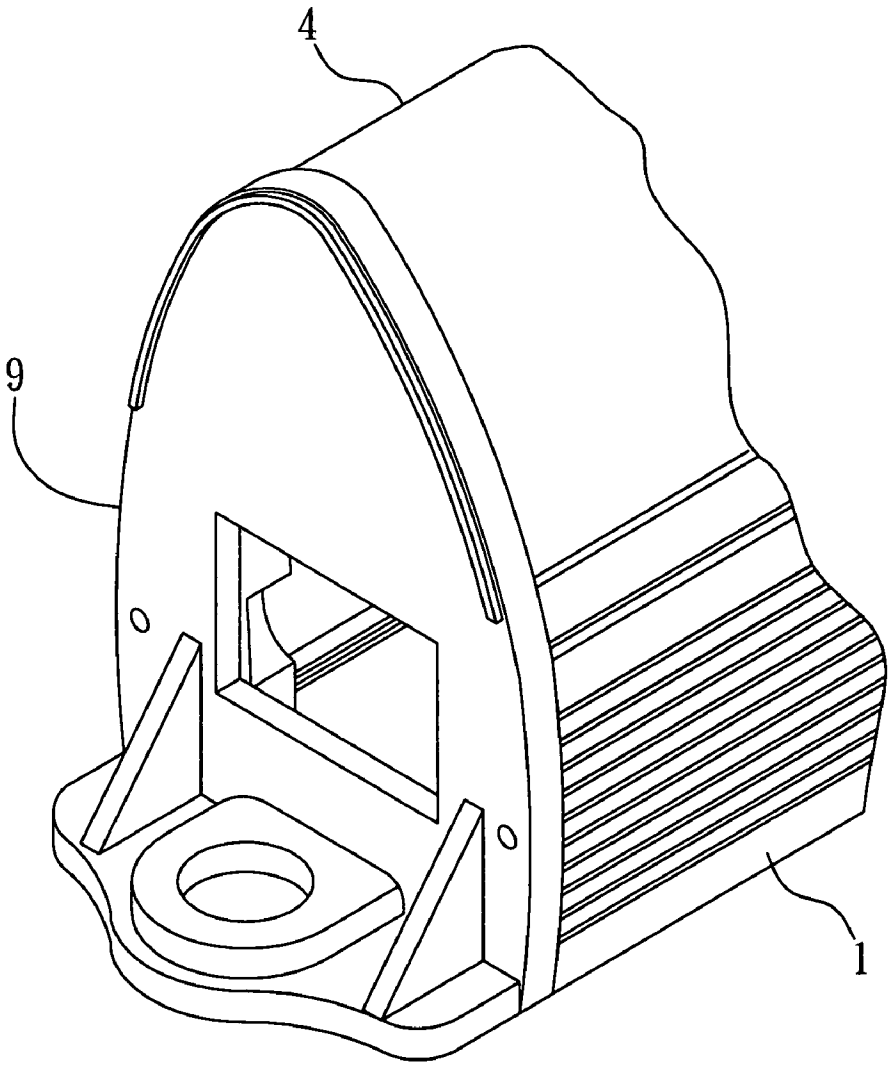
FIG. 7 is an assembly diagram of FIG. 2.

FIGS. 6 and 7 are diagrams depicting a second embodiment of the light-emitting device of the present invention. Elements that are similar or equal to those shown in the first embodiment are denoted with similar to equal reference numbers, and their description are omitted in order not to obscure the understanding of the present invention.

The main difference of the present embodiment and the second embodiment is that a fastening element is added in the present embodiment.

As shown in FIG. 6, the body 1 further comprises a seventh joining portion 17, such as a track. A fastening element 9 is disposed at one side of the body 1, which can be an end cap, for example. The fastening element 9 comprises an eighth joining portion 91 corresponding to the seventh joining portion 17, a through hole 92 in the eighth joining portion 91 and a ninth joining portion 93 located next to the eighth joining portion 91. The eighth joining portion 91 is, for example, an arc indentation to correspondingly couple to the seventh joining portion 17. The ninth joining portion 93 can be a protrusion corresponding to the eighth joining portion 91, such that the ninth joining portion 93 is wedged between the sixth joining portion 15 and the seventh joining portion 17.

To assembly the light-emitting device of the present embodiment, the eighth joining portion 91 can be correspondingly fastened to the seventh joining portion 17 and the ninth joining portion 93 is inserted between the sixth joining portion 15 and the seventh joining portion 17, so as to first assemble the fastening element 9 to one end of the body 1. Thereafter, the base 5 with the plurality of light-emitting elements 3 is assembled to the body 1. Finally, the optical processing element 4 is assembled to a side of the body 1. Alternatively, the optical processing element 4 and the base 5 can be first assembled to a side of the body 1, and then the fastening element 9 is assembled to one end of the body 1. The order of assembly should be construed as illustrative rather than limiting.

Upon finishing the assembly, as shown in FIG. 7, the fastening element 9 is located at one end of the light-emitting device of this embodiment. The fastening element 9 blocks one side of the body 1, the optical processing element 4 and the base 5 (not shown in FIG. 7).

Additionally, although the fastening element 9 is illustrated in this embodiment for preventing movement or separation of the optical processing element 4 and/or the base 5 and the power supplying unit 8 from the body 1, but the structure for fastening the optical processing element 4 and/or the base 5 and the power supplying unit 8 is not limited to that shown herein. For example, a buckling element (not shown) can be provided in the body 1 for buckling the optical processing element 4 and/or the base 5. Such modification is obvious to one with ordinary skills in the art, so it will not be further illustrated.

Furthermore, in the first and second embodiments, connections in parallel come before connections in series for electrical connection. For example, the light-emitting elements 3 are first connected in parallel then in series. One voltage regulator 7 is connected between light-emitting elements that are connected in parallel, and several voltage regulators are connected between light-emitting elements that are in series. However, the configurations are not limited to these. In other embodiments, the voltage regulators 7 can be omitted. In addition, although the base 5 in both the first and the second embodiments are shown as separated from the body, but the base can be integrated with the body 1 as one in other embodiments.

The above embodiments are only used to illustrate the principles of the present invention, and they should not be construed as to limit the present invention in any way. The above embodiments can be modified by those with ordinary skills in the arts without departing from the scope of the present invention as defined in the following appended claims.

What is claimed is:

1. A light-emitting device, comprising:

a body including a first joining portion;

a plurality of light-emitting element located at a side of the body having the first joining portion for emitting light; and an optical processing element disposed at a side of the plurality of light-emitting elements including a second joining portion corresponding to the first joining portion for processing light emitted from each light-emitting element, such that even light emission is obtained;

wherein the body further comprises a base for disposing the light-emitting elements, and the base comprises an adhesive gel for fixing the light-emitting elements on the base, a groove on a face of the base, a circuit board in the groove having a plurality of receiving portions for receiving the light-emitting elements, wires for electrically connecting the circuit board and the light-emitting elements, a resin filled in the receiving portions for covering the light-emitting elements, and power lines electrically connected to the circuit board.

2. The light-emitting device of claim 1, wherein the body is a hollow frame.

3. The light-emitting device of claim 1, wherein the first joining portion is a track.

4. The light-emitting device of claim 1, wherein the body further comprises a third joining portion, the base comprising a fourth joining portion corresponding to the third joining portion.

5. The light-emitting device of claim 1, wherein the base is a metal heat-dissipating base.

6. The light-emitting device of claim 1, wherein the circuit board is a printed circuit board, the wires are gold wires, the resin is an epoxy resin, and the power lines pass through the base.

7. The light-emitting device of claim 1, wherein the light-emitting elements are first connected in parallel then in series for electrical connection.

8. The light-emitting device of claim 1, further comprising at least one voltage regulator electrically connected to at least one of the light-emitting elements.

9. The light-emitting device of claim 8, wherein one of the at least one voltage a regulator is connected to nine light-emitting elements.

10. The light-emitting device of claim 8, wherein the voltage regulator is a Zoner diode.

11. The light-emitting device of claim 1, wherein the optical processing element is a transparent spreading plate.

12. The light-emitting device of claim 1, wherein the second joining portion is one of a protruding rib and a tenon.

13. The light-emitting device of claim 1, wherein the optical processing element comprises a first face and a second face opposite to the first face.

14. The light-emitting device of claim 13, wherein the first face is provided with a first processing portion and the second face is provided with a second processing portion.

15. The light-emitting device of claim 14, wherein the first processing portion is a continuous-arc pattern and the second processing portion is also a continuous-arc pattern, wherein the radius of the arc pattern of the first processing portion is not equal to that of the arc pattern of the second procession portion.

16. The light-emitting device of claim 1, further comprising a fastening element located at one end of the body.

17. The light-emitting device of claim 16, wherein the fastening element is an end cap.

18. The light-emitting device of claim 6, wherein the base further comprises a wave structure on another face of the base.

19. A light-emitting device, comprising:

a body including a first joining portion;

a plurality of light-emitting element located at a side of the body having the first joining portion for emitting light; and an optical processing disposed at a side of the plurality of light-emitting elements including a second joining portion corresponding to the first joining portion for processing light emitted from each light-emitting element, such that even light emission is obtained;

wherein the body further comprises a base for disposing the light-emitting elements, and the base comprises an adhesive gel for fixing the light-emitting elements on the base, a groove on a face of the base, a wave structure on the other face of the base, a printed circuit board in the groove having a plurality of receiving portions for receiving the light-emitting elements, gold wires for electrically connecting the printed circuit board and the light-emitting elements, an epoxy resin filled in the receiving portions for covering the light-emitting elements, and power lines through the base and electrically connected to the printed circuit board.

* * * * *